US006948727B1

(12) United States Patent
Bakken

(10) Patent No.: US 6,948,727 B1
(45) Date of Patent: Sep. 27, 2005

(54) COLLAPSIBLE WALKER

(76) Inventor: Bettelou D. Bakken, 11411 N. 91st Ave. #4, Peoria, AZ (US) 85345

( * ) Notice: Subject to any disclaimer, the term of this patent is extended or adjusted under 35 U.S.C. 154(b) by 34 days.

(21) Appl. No.: 10/259,923

(22) Filed: Sep. 27, 2002

(51) Int. Cl.[7] ..... B63B 22/20; A61H 3/04

(52) U.S. Cl. ..... 280/87.021; 280/87.051; 135/67; 296/5; 482/68

(58) Field of Search ..... 135/67, 66, 85; 280/87.01, 87.021, 87.051, 647; 297/136–139, 297/148, 5–7; 482/66–68

(56) References Cited

U.S. PATENT DOCUMENTS

| | | | | | |
|---|---|---|---|---|---|
| 11,140 | A | * | 6/1854 | Burkholder | 297/5 |
| D148,552 | S | * | 2/1948 | Marcus | D12/130 |
| 2,665,742 | A | * | 1/1954 | Starysky | 297/137 |
| D181,957 | S | | 1/1958 | Callahan | |
| 3,515,404 | A | * | 6/1970 | Perego | 280/87.051 |
| 4,100,415 | A | * | 7/1978 | Blaisdell et al. | 250/455.11 |
| 4,226,413 | A | | 10/1980 | Daugherty | |
| 4,272,071 | A | * | 6/1981 | Bolton | 482/67 |
| 4,342,465 | A | * | 8/1982 | Stillings | 280/87.051 |
| 4,452,484 | A | | 6/1984 | Pastor | |
| 5,040,556 | A | * | 8/1991 | Raines | 135/67 |
| 5,133,377 | A | | 7/1992 | Truxillo | |
| 5,228,708 | A | * | 7/1993 | Verdugo | 280/200 |
| 5,273,063 | A | | 12/1993 | Farr et al. | |
| 5,380,023 | A | * | 1/1995 | McBee | 280/87.01 |
| 5,380,262 | A | * | 1/1995 | Austin | 482/68 |
| 5,458,394 | A | * | 10/1995 | Nichols et al. | 297/173 |
| 5,819,772 | A | | 10/1998 | Pi | |

FOREIGN PATENT DOCUMENTS

| | | | |
|---|---|---|---|
| EP | 478114 | * | 1/1992 |

* cited by examiner

*Primary Examiner*—Winnie Yip

(57) ABSTRACT

A collapsible walker for providing a user with a walking aid that would be designed for greater comfort and mobility. The collapsible walker includes a base assembly that has perimeter wall. The base member is substantially hollow. The base assembly substantially encircles a user. A plurality of wheels is operationally coupled to a lower end of the base assembly. The plurality of wheels facilitating rolling the base assembly along a horizontal support surface such as a floor. A hand hold portion is operationally coupled to an upper end of the base assembly. The hand hold portion facilitating assistance by a care-giver during use.

9 Claims, 4 Drawing Sheets

46
44
48
42
40
22
30
38
24
14
18
64
16
60
62
16

COLLAPSIBLE WALKER

BACKGROUND OF THE INVENTION

1. Field of the Invention

The present invention relates to walkers and more particularly pertains to a new collapsable walker for providing a user with a walking aid that would be designed for greater comfort and mobility.

2. Description of the Prior Art

The use of walkers is known in the prior art. U.S. Pat. No. 4,226,413 describes a wheel mounted walker with foot pedal brake. Another type of walker is U.S. Pat. No. 5,273,063 describing a folding tray for invalid walkers. U.S. Pat. No. 5,133,377 describes an invalid walker having a set of specially designed spring biased retractable casters. U.S. Pat. No. 4,452,484 describes a walker having a removably mounted seat. U.S. Pat. No. 5,819,772 describes a walker for disabled persons which includes a rectangular open back frame. U.S. Pat. No. Des. 181,957 describes an ornamental design for a walker.

While these devices fulfill their respective, particular objectives and requirements, the need remains for a device that would entirely encompass the user providing them with greater support and be easily adjustable in height.

SUMMARY OF THE INVENTION

The present invention meets the needs presented above by utilizing a seat member and utilizing a separable design using multiple base members.

Another object of the present invention is to provide a new collapsable walker that would provide greater body support and would be easier to manipulate than walkers requiring the user to stand.

Still another object of the present invention is to provide a new collapsable walker that would provide greater safety to individuals and it would provide increased assurance over conventional equipment.

To this end, the present invention generally comprises a base assembly that has perimeter wall. The base member is substantially hollow. The base assembly substantially encircles a user. A plurality of wheels is operationally coupled to a lower end of the base assembly. The plurality of wheels facilitating rolling the base assembly along a horizontal support surface such as a floor. A hand hold portion is operationally coupled to an upper end of the base assembly. The hand hold portion facilitating assistance by a care-giver during use.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
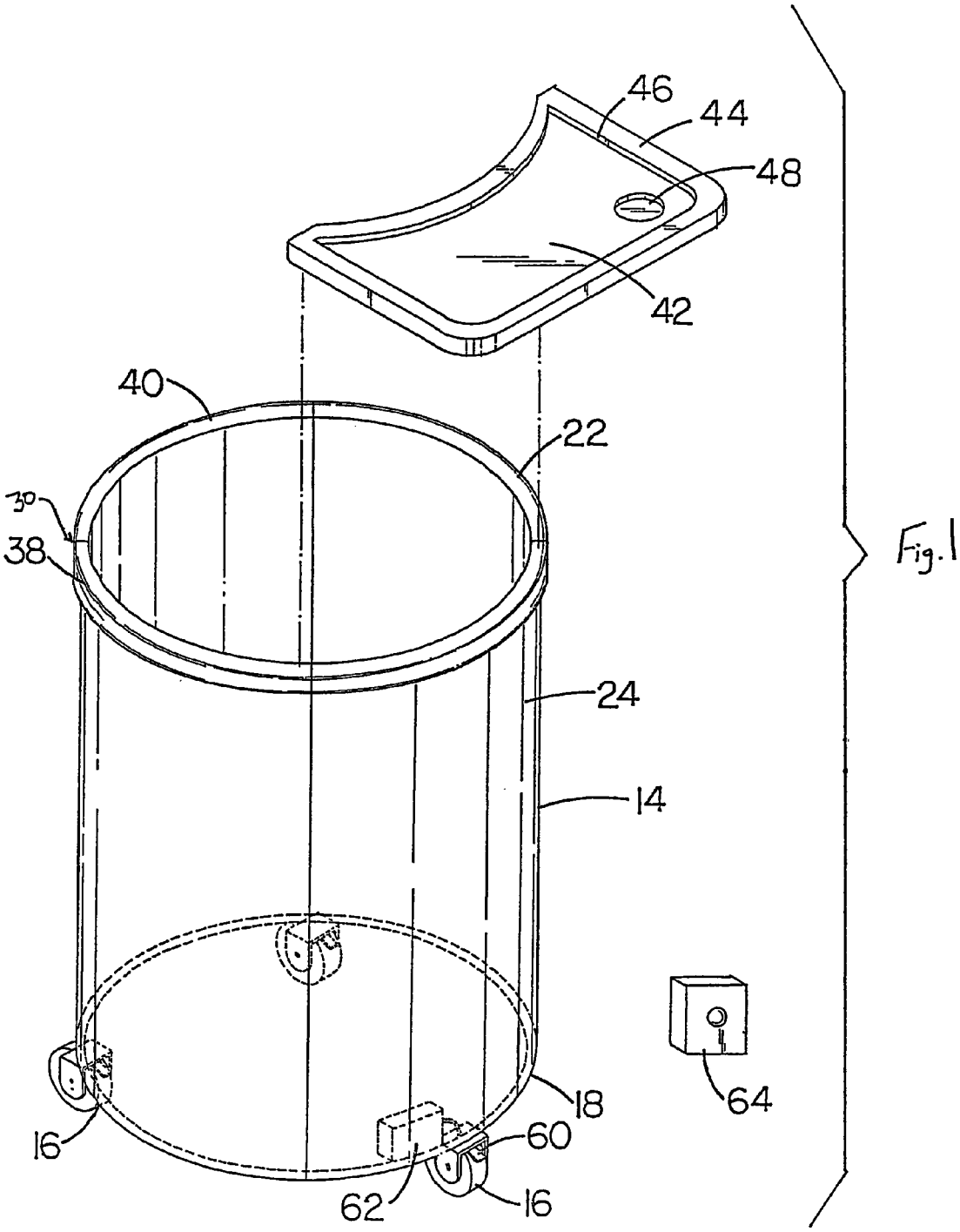
FIG. 1 is a perspective view of a new collapsable walker according to the present invention.
Figure 4:
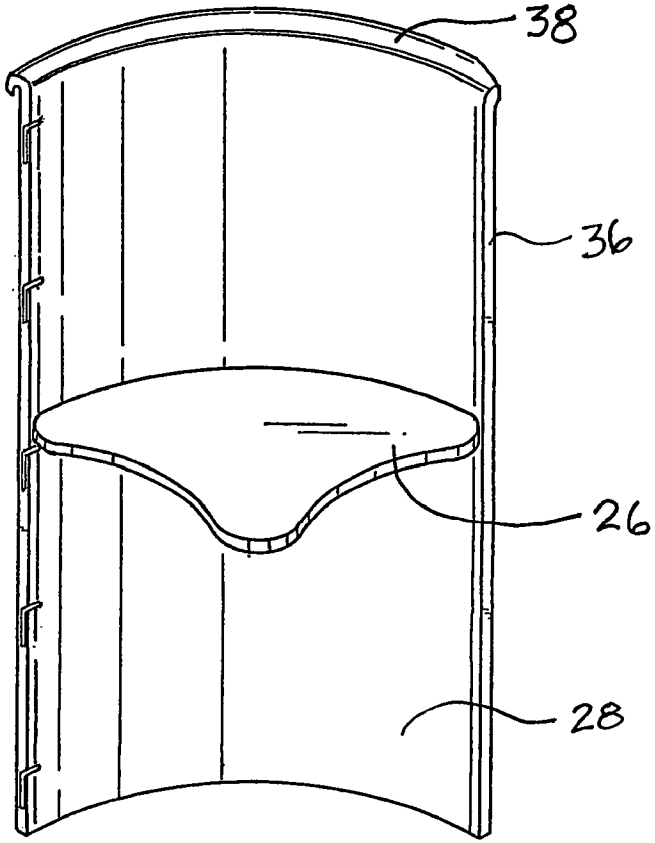
FIG. 4 is a perspective view of the present invention.
Figure 2:
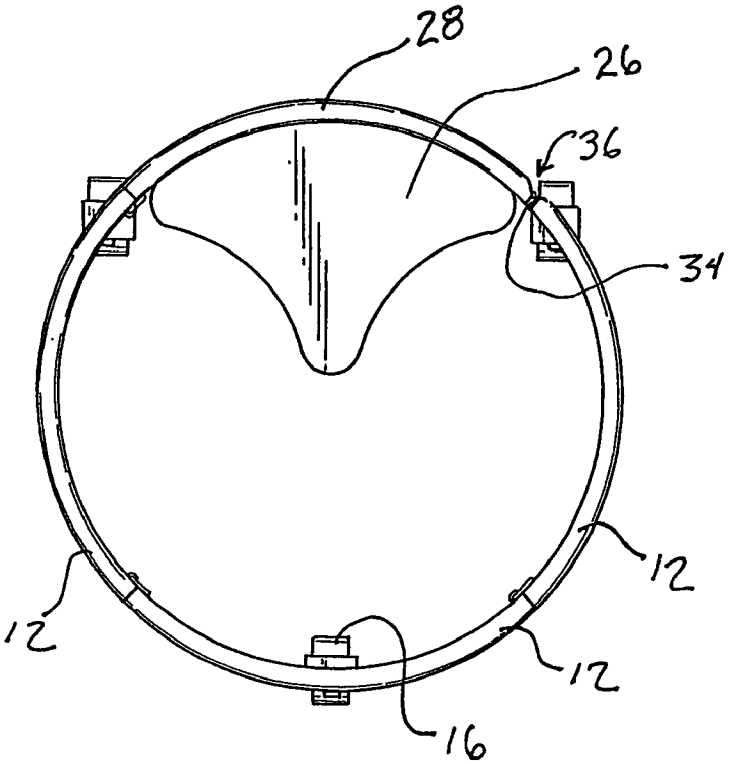
FIG. 2 is a top view of the present invention.
Figure 3:
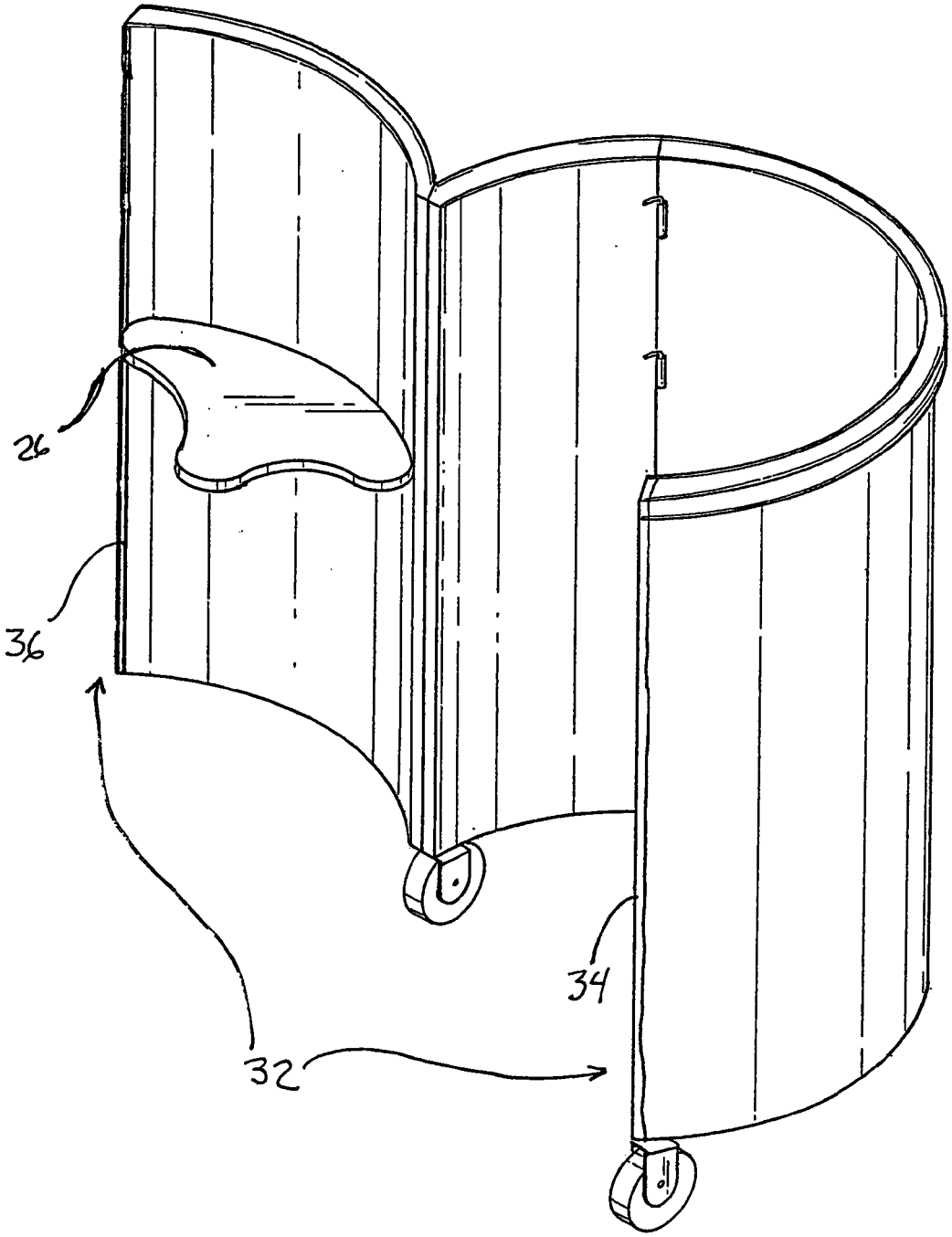
FIG. 3 is a perspective view of the present invention.
Figure 5:
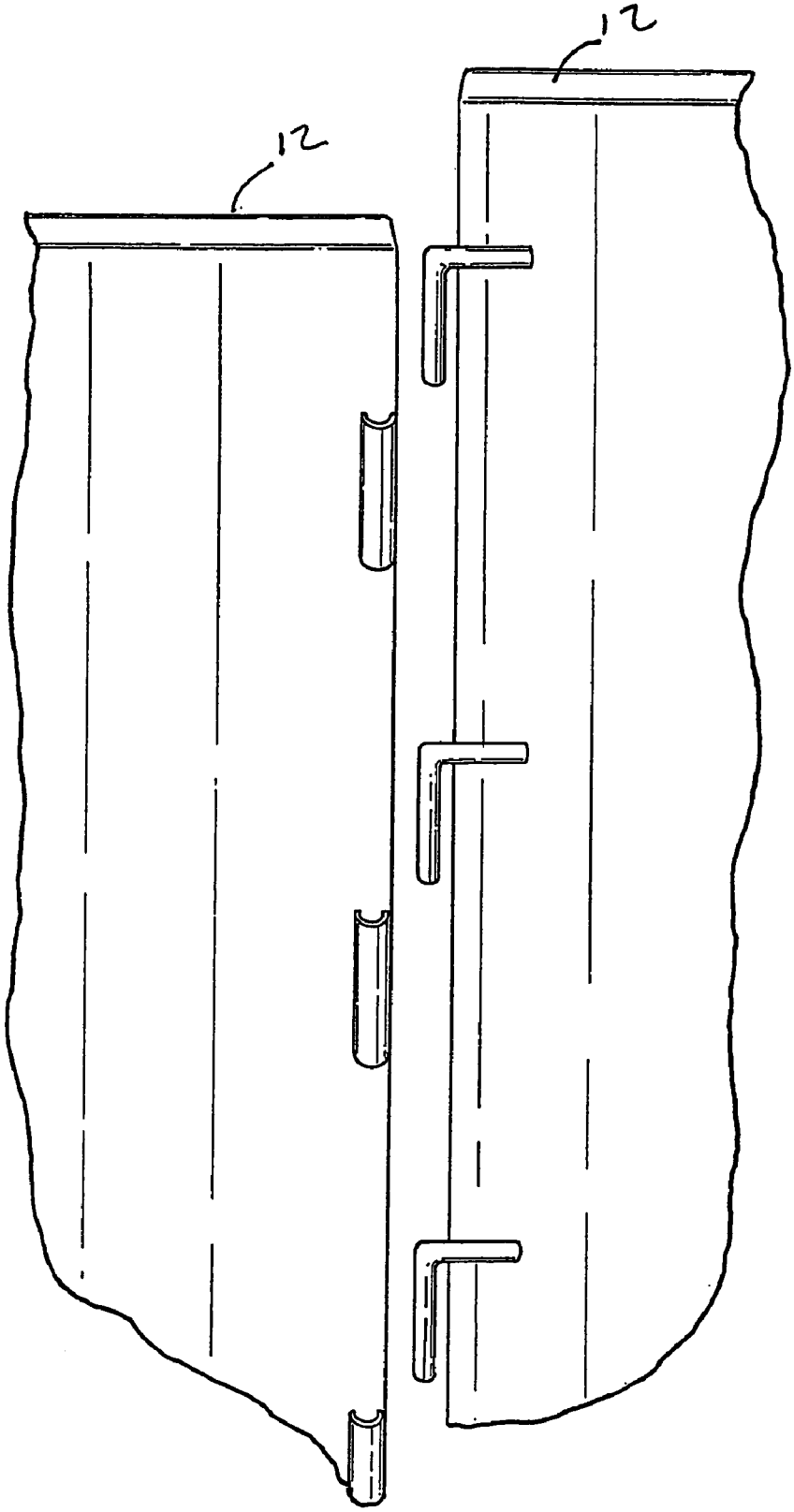
FIG. 5 is a cross-sectional view of the present invention.

With reference now to the drawings, and in particular to FIGS. 1 through 5 thereof, a new collapsable walker embodying the principles and concepts of the present invention and generally designated by the reference numeral 10 will be described.

As best illustrated in FIGS. 1 through 5, the collapsable walker 10 generally comprises a base assembly 12 that has perimeter wall 14. The base assembly 12 is substantially hollow. The base assembly 12 substantially encircles a user. A plurality of wheels 16 is operationally coupled to a lower end 18 of the base assembly 12. The plurality of wheels 16 facilitating rolling the base assembly 12 along a horizontal support surface such as a floor. A hand hold portion 20 is operationally coupled to an upper end 22 of the base assembly 12. The hand hold portion 20 is for facilitating assistance by a care-giver during use.

Each of a plurality of base members 24 has a perimeter wall 14. Each one of the base members 24 is couplable to an adjoining one of said plurality of base members 24, such that said collapsible walker 10 may be disassembled for ease of transport and storage. Each one of the base members 24 being a separate vertical section. The plurality of base members 24 provides support for the user.

A seat member 26 is coupled to one of the plurality of base members 24. The seat member 26 provides a resting surface of the user during rest. The seat member 26 is designed for supporting a posterior of the user.

The base assembly 12 has a substantially c-shaped cross-section. The base assembly 12 substantially encircles three sides of the user. The base assembly 12 provides vertical support for the user during use. A door portion 28 is operationally coupled to the base assembly 12. The door portion 28 is substantially arcuate such that the base assembly 12 and the door portion 28 has a substantially circular cross-section when the door portion 28 is in a first position. The door portion 28 facilitates ingress and egress from the assembly by the user. The base assembly 12 further includes a closure means 30 for selectively securing the door portion 28 in a first portion whereby the user is substantially encircles on all sides.

The closure means 30 is a magnetic latch assembly 32. The magnetic latch assembly 32 has a first portion 34 coupled to an edge of the base assembly 12. The magnetic latch assembly 32 has a second portion 36 coupled to an edge of the door portion 28. The first portion 34 abutts the second portion 36 when the door portion 28 is in a first position. The first portion 34 is magnetically attracted to the second portion 36.

The hand hold portion 20 further includes a rolled rail member 38 that extends outwardly from a top edge 40 of the base assembly 12. The rolled rail member 38 provides a surface designed to be grasped by a human hand. The rolled rail member 38 provides a hand hold for a care-giver such that the walker assembly 10 may be steadied during use by the care-giver.

A tray portion 42 is couplable to a top edge 40 of the base assembly 12. The tray portion 42 provides a horizontal support surface for user accessories during use. The tray portion 42 further includes a raised rim portion 44 adjacent to a perimeter edge 46 of the tray portion 42. The raised rim portion 44 is for inhibiting spillage from the tray portion 42 onto a horizontal support surface such as a floor. The tray portion 42 further includes a cup holder 48 for selectively receiving a beverage container thereby allowing the user to maintain both hands on the base assembly during use.

The base assembly 12 has an overall height in the range between 36 and 48 inches inclusive. The base assembly 12 has an overall width of approximately 30 inches.

In a further embodiment, a brake assembly 60 is operationally coupled to at least one of the wheels 16. A radio receiver 62 is operationally coupled to the brake assembly 60. A radio transmitter 64 may be carried by the care giver for remotely activating the brake assembly 60.

In use, a user would enter through the door portion, when open the user could walk into the unit close the door portion and be seated in the seat member. A tray portion would be secured to the front of the present invention. The tray portion could secure dining accessories, writing tablets, as other accessories.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A walker assembly for use by mobility challenged individuals, comprising:

a base assembly having an upper end defining an upper opening for extending a relatively upper portion of a body of a user therethrough, a lower end defining a lower opening end for extending a relatively lower portion of the body of the user therethrough, and a perimeter wall, said perimeter wall extending in a substantially continuous and uninterrupted manner between said upper end and said lower end, said base assembly being substantially hollow inside said perimeter wall such that said base assembly substantially encircles the user's torso when the user utilizes said walker assembly;

a plurality of wheels operationally coupled to the lower end of said base assembly, said plurality of wheels facilitating rolling said base assembly along a horizontal support surface;

a hand hold portion operationally coupled to the upper end of said base assembly, said hand hold portion facilitating assistance by a care-giver during use;

wherein said base assembly comprises:

a main portion with a substantially c-shaped transverse cross-section for substantially encircling three sides of the user;

a door portion pivotally mounted to the main portion of said base assembly and having a substantially arcuate transverse cross section such that said main portion and said door portion form a substantially circular transverse cross-section for said base assembly when said door portion is in a first, closed position, said door portion facilitating ingress and egress from said assembly by the user when said door portion is in a second, open position; and a seat member coupled to said perimeter wall of same base assembly for providing a resting surface for supporting a posterior of the user during rest.

2. The walker assembly of claim 1, wherein said base assembly further comprises:

a plurality of base members, each one of said base members having a portion of said perimeter wall, each one of said base members being a vertical section and being couplable to an adjoining base member such that said perimeter wall is formed by said plurality of base members, said plurality of base members providing support for the user, said plurality of base members facilitating disassembly of said base assembly during transportation and storage.

3. The walker assembly of claim 1, wherein said hand hold portion further comprises a rolled rail member extending outwardly from a top edge of said base assembly for being grasped by a human hand.

4. The walker assembly of claim 1, further comprising a tray portion couplable to a top edge of said base assembly for providing a horizontal support surface for user accessories during use, said tray portion having a perimeter edge, a portion of said perimeter edge having a curvature corresponding to a curvature of the main portion of said base assembly to facilitate coupling of the curved portion of said perimeter edge.

5. The walker assembly of claim 4 wherein said tray portion further comprises a raised rim portion adjacent to a perimeter edge of said tray portion inhibiting spillage from said tray portion onto a horizontal support surface.

6. The walker assembly of claim 4, wherein said tray portion further comprises a cup holder for selectively receiving a beverage container thereby allowing the user to maintain both hands on said base assembly during use.

7. The walker assembly of claim 1 additionally comprising a securing means for selectively securing said door portion in said first position.

8. The walker assembly of claim 7 wherein said securing means comprises a magnetic latch assembly, said magnetic latch assembly having a first portion coupled to an edge of the main portion of said base assembly, said magnetic latch assembly having a second portion coupled to an edge of the door portion of said base assembly, said first portion abutting said second portion when said door portion is in the first position, said first portion being magnetically attracted to said second portion.

9. A walker assembly for use by mobility challenged individuals, comprising:

a base assembly having a perimeter wall, said base assembly being substantially hollow, said base assembly substantially encircling a user;

a plurality of wheels operationally coupled to a lower end of said base assembly, said plurality of wheels facilitating rolling said base assembly along a horizontal support surface; and a hand hold portion operationally coupled to an upper end of said base assembly, said hand hold portion facilitating assistance by a care-giver during use;

wherein said base assembly comprises a plurality of base members, each one of said base members having a perimeter wall, each one of said base members being a vertical section and being couplable to an adjoining base member such that said perimeter wall is formed by said plurality of base members, said plurality of base members providing support for the user, said plurality of base members facilitating disassembly of said base assembly during transportation and storage; and a seat member coupled to one of said plurality of base members, said seat member providing a resting surface of the user during rest, said seat member being adapted for supporting a posterior of the user;

wherein said base assembly having a substantially c-shaped cross-section, said base assembly substantially encircling three sides of the user, said base assembly providing vertical support for the user during use;

a door portion operationally coupled to said base assembly, said door portion being substantially arcuate such that said base assembly and said door portion having a substantially circular cross-section when said door portion being in a first position, said door portion facilitating ingress and egress from said assembly by the user;

wherein said base assembly further comprises a closure means for selectively securing said door portion in a first portion whereby the user is substantially encircles on all sides;

wherein said closure means being a magnetic latch assembly, said magnetic latch assembly having a first portion coupled to an edge of said base assembly, said magnetic latch assembly having a second portion coupled to an edge of said door portion, said first portion abutting said second portion when said door portion being in a first position, said first portion being magnetically attracted to said second portion;

wherein said hand hold portion further comprises a rolled rail member extending outwardly from a top edge of said base assembly, said rolled rail member providing a surface adapted for being grasped by a human hand, said rolled rail member providing a hand hold for a care-giver such that said walker assembly may be steadied during use by the care-giver;

wherein a tray portion couplable to a top edge of said base assembly, said tray portion providing a horizontal support surface for user accessories during use;

wherein said tray portion further comprises a raised rim portion adjacent to a perimeter edge of said tray portion, said raised rim portion being for inhibiting spillage from said tray portion onto a horizontal support surface;

wherein said tray portion further comprises a cup holder for selectively receiving a beverage container thereby allowing the user to maintain both hands on said base assembly during use;

wherein said base assembly having an overall height in the range between 36 and 48 inches inclusive;

wherein said base assembly having an overall width of approximately 30 inches;

a brake assembly operationally coupled to at least one of said plurality of wheels such that said walker assembly is held in a static position relative to a horizontal support surface when said brake assembly is activated;

a brake remote control such that said brake assembly is selectively activated by a care giver; and wherein said remote control further comprises:

a plurality of brake members, each one of said plurality of brake members being operationally coupled to an associated one of said plurality of wheels;

a radio receiver coupled to said base assembly, said radio receiver being operationally coupled to each one of said plurality of brake members, said radio receiver facilitating selectively activating said plurality of brake members; and a radio transmitter carryable by a care giver, said radio transmitter being for selectively activating said plurality of brake members remotely.

* * * * *